US006896564B2

(12) United States Patent
Willmot

(10) Patent No.: US 6,896,564 B2
(45) Date of Patent: May 24, 2005

(54) MOTOR FOR DRIVING A PROPELLER INCLUDING A PHASE ADJUSTER

(75) Inventor: Eric Paul Willmot, Mount Eliza (AU)

(73) Assignee: Aimbridge Pty. Ltd., Melbourne (AU)

( * ) Notice: Subject to any disclaimer, the term of this patent is extended or adjusted under 35 U.S.C. 154(b) by 0 days.

(21) Appl. No.: 10/770,320

(22) Filed: Feb. 2, 2004

(65) Prior Publication Data

US 2004/0157509 A1 Aug. 12, 2004

Related U.S. Application Data

(63) Continuation of application No. 09/958,729, filed as application No. PCT/AU99/00276 on Apr. 15, 1999, now Pat. No. 6,688,926.

(30) Foreign Application Priority Data

Jun. 25, 1998 (AU) ..... PP4331

(51) Int. Cl.[7] ..... B63H 3/00
(52) U.S. Cl. ..... 440/50; 416/165
(58) Field of Search ..... 440/50, 83; 416/157 R, 416/165

(56) References Cited

U.S. PATENT DOCUMENTS 3,795,463 A * 3/1974 Herbert ..... 416/207
3,912,417 A 10/1975 Herbert (Continued)

FOREIGN PATENT DOCUMENTS

AU 9467443 7/1994
GB 531756 1/1941

(Continued)

OTHER PUBLICATIONS

International Search Report completed for International Application No. PCT/AU 99/00276 which was published as International Publication No. WO 99/67128 under International Publication Date Dec. 29, 1999 and mailed Jun. 22, 1999.

Supplementary European Search Report for Application No. EP 99 91 3021 completed on Jun. 14, 2002.

*Primary Examiner*—Andrew D. Wright
(74) *Attorney, Agent, or Firm*—Bromberg & Sunstein LLP

(57) ABSTRACT

A motor for driving a propeller is disclosed which has a drive shaft (10) which is coupleable to a propeller shaft (20) by bevel gears (12 and 14) so as to rotate the shaft (20) to in turn rotate propeller blades P of an outboard motor. The drive shaft (20) has an internal concentric shaft (30) which enables the adjustment of the pitch of the propeller blades P by mounting the propeller blades P for rotation about a pitch axis and coupling the mounting (72') via an integral bevel gear (104) to a bevel gear (102) on the shaft (30). A phase adjustment mechanism (40) is provided for rotating the shaft (30) relative to the shaft (20) to in turn rotate the propeller blades P around the pitch axis to change the pitch of the propeller blades P. The phase adjustment mechanism comprises ring gears (48 and 50), together with planet gears (48) in engagement with a gear on the shaft (30) and planet gears (46) in engagement with a gear (26) on the shaft (20). An anti-backlash mechanism for preventing movement with propeller blades P about the pitch axis due to backlash within the gears of the phase adjuster mechanism (40), includes a screw-threaded section (252) coupled with the shaft (30) and the yoke (270) on the section (252) for movement on the section (252) in the longitudinal direction of the shaft (30). Engagement between the screw-threaded section (252) and the yoke (270) forms a rigid coupling of the shaft (30) to the propeller blades P so that any backlash in the phase adjusting mechanism (40) is not transmitted through the coupling to the propeller blades P.

5 Claims, 7 Drawing Sheets

U.S. PATENT DOCUMENTS

| | | | | | |
|---|---|---|---|---|---|
| 4,362,467 | A | | 12/1982 | Elliott | |
| 4,893,989 | A | * | 1/1990 | Carvalho | 416/157 R |
| 4,929,201 | A | | 5/1990 | Pitt | |
| 5,174,716 | A | | 12/1992 | Hora et al. | |
| 5,431,539 | A | * | 7/1995 | Carvalho | 416/168 R |
| 5,451,141 | A | * | 9/1995 | Carvalho et al. | 416/152 |
| 5,462,410 | A | * | 10/1995 | Smith et al. | 416/165 |
| 5,762,474 | A | | 6/1998 | Chatelain | |
| 5,967,750 | A | * | 10/1999 | Elliott | 416/61 |
| 5,967,753 | A | * | 10/1999 | Muller | 416/167 |
| 6,364,610 | B1 | * | 4/2002 | Muller | 416/153 |

FOREIGN PATENT DOCUMENTS

| | | |
|---|---|---|
| GB | 569056 | 5/1945 |
| GB | 627846 | 8/1949 |
| GB | 2168435 A | 6/1986 |
| WO | WO 85/10490 | 4/1985 |
| WO | WO 97/30813 | 8/1997 |
| WO | WO 99/15399 | 4/1999 |
| WO | WO 99/15400 | 4/1999 |
| WO | WO 99/19208 | 4/1999 |

* cited by examiner

MOTOR FOR DRIVING A PROPELLER INCLUDING A PHASE ADJUSTER

CROSS REFERENCE TO RELATED APPLICATIONS

The present application is a continuation of U.S. patent application No. 09/958,729, filed Oct. 12, 2001, now U.S. Pat. No. 6,688,926, issued Feb. 10, 2004, which was based on International Application number PCT/AU99/00276, filed Apr. 15, 1999. Each of these applications, as well the issued patent, is hereby incorporated herein by reference.

TECHNICAL FIELD

This invention relates to a motor for driving a propeller which includes a phase adjuster for changing the pitch of the propeller blades of the propeller.

BACKGROUND ART

Generally motors, and in particularly outboard motors for use with boats, include a drive shaft for transmitting rotary power to a propeller for rotating the propeller to drive the boat through the water. The propeller includes propeller blades which are angled to provide propulsion through the water. The angle or pitch of the blades relative to a radial axis transverse to the drive axis of the drive shaft is generally fixed and selected to provide maximum efficiency at maximum speed or cruise speed of the boat to which the motor is to be used. The pitch is generally less efficient at take-off when the boat is driven from stationary up to the cruise speed, which inefficiency results in increased fuel consumption and a longer time for the boat to move from the stationary to cruise speed.

The object of this invention is to provide a motor which overcomes these problems.

SUMMARY OF THE INVENTION

The invention may be said to reside in a motor for driving a propeller having a plurality of propeller blades, including: a first output shaft having a drive axis for driving the propeller around the drive axis; a second output shaft having a drive axis; coupling means for coupling the second output shaft to each propeller blade of the propeller for rotating the propeller blades about a radial axis transverse to the drive axes of the first and second output shafts to change the pitch of the propeller blades relative to the radial axis; an input for supplying input rotary power to the first and second output shafts for driving the first and second output shafts about the drive axes to transmit rotary power to the propeller; and phase adjusting means for adjusting the phase relationship between the first and second output shafts so that one of the output shafts rotates relative to the other of the output shafts with the relative rotation causing the coupling means to rotate the propeller blades about the radial axis to change the pitch of the blades relative to the radial axis.

The phase adjusting means allows the pitch of the propeller blades to be altered so the pitch can be set at an optimum position for maximum efficiency at take-off of the vessel as the vessel moves from a stationary position and readjusted to provide maximum efficiency at cruise speed. Thus, an optimum pitch of the propeller blades can be selected depending on the conditions of the motor and speed of travel of the vessel to which the motor is coupled. This increases efficiency of the motor and decreases fuel consumption.

Preferably the coupling means comprises a bevel gear on the second output shaft which meshes with a bevel gear coupled to each propeller blade for rotating the propeller blades about the radial axis.

Preferably the propeller blades are each provided on a blade mounting, the blade mounting being coupled to the first output shaft for rotation with the first output shaft about the drive axis so that when the first and second output shafts rotate at the same speed drive is not transmitted from the first bevel gear on the second output shaft to the bevel gear on the mounting, but when relative rotation takes place between the first and second output shafts drive is transmitted from the bevel gear connected to the second output shaft to the bevel gear on the mounting to cause the mounting to rotate about the radial axis to alter the pitch of the propeller blade.

Preferably the phase adjusting means comprises: a cage coupled to the input via the first and second output shafts and the input for input of rotary power; a first gear on the first output shaft; a second gear on the second output shaft; a first planet gear in meshing engagement with the first gear on the first output shaft; a second planet gear in meshing engagement with the second gear on the second output shaft; a first orbit gear arranged for rotation relative to the first and second outputs and meshing with the first planet gear and a second output gear arranged for rotation relative to the outputs and engaging the second planet gear, one of the first or second orbit gears being fixed and the other of the first or second orbit gears being movable relative to the said one of the orbit gears; and adjusting means for moving the movable orbit gear to cause the planet gear associated with that orbit gear to advance or regress relative to the other planet gear to thereby change the phase relationship between the first and second output shafts and to alter the pitch of the propeller blades via the coupling means which couples the second output shaft to each propeller blade.

In the preferred embodiment of the invention, the phase adjusting means includes a plurality of gears as described above. The geared arrangement of the phase adjusting means and the geared coupling of the second shaft to the propeller blades inherently allows for some backlash in the gear train which may be undesirable. The backlash in the gear train can, depending on the position of the propeller blades, cause the propeller blades to oscillate slightly about the radial axis which may make the motor ineffective or inefficient. The oscillating movement of the propeller blades can take place if the centre of gravity of the propeller blades is so positioned that the backlash in the gear train and the center of gravity can cause the propeller blade to shift slightly after being positioned at a particular pitch angle with respect to the radial axis.

In one preferred embodiment of the invention, the motor therefore further includes backlash preventing means for preventing movement of the propeller blade about the radial axis due to any backlash in the phase adjusting means so any backlash is not transmitted to the propeller blades which may otherwise cause the propeller blades to oscillate.

Preferably the backlash preventing means is provided in the coupling means for coupling each propeller blade to the second output shaft and includes: a screw-thread section coupled to or provided on the second output shaft; a yoke provided on the screw-threaded section for movement on the screw-threaded section in the longitudinal direction of the second output shaft; and the engagement between the screw-threaded section and the yoke forms a substantially rigid coupling of the second output shaft to the propeller blades so that any backlash in the phase adjusting means is not transmitted through the coupling means to the propeller blades.

The prevention of any backlash being transmitted to the propeller blades occurs because of the screw-threaded nature of the backlash preventing means within the coupling means which does not allow any play or backlash in the drive train from the phase adjusting means, second output shaft and coupling means to the propeller blades.

In this embodiment of the invention, the coupling means further includes means for preventing rotation of the yoke on the screw-threaded section so that when the second output shaft is rotated relative to the first output shaft, the yoke is caused to move longitudinally on the screw-threaded section, the coupling means further having a link coupled between the yoke and the propeller blade so that when the yoke moves on the screw-threaded section, the link is moved to in turn cause the propeller blade to rotate about the radial axis to adjust the pitch of the blades relative to the radial axis.

BRIEF DESCRIPTION OF THE DRAWINGS

A preferred embodiment of the invention will be described, by way of example, with reference to the accompanying drawings in which.

DETAILED DESCRIPTION OF SPECIFIC EMBODIMENTS

The preferred embodiments of the invention will be described with reference to the motor being an outboard motor for use with a boat. However, it should be understood that the motor could be used in other environments in which a motor is required to drive a propeller such as motor driven floatable or submergible vehicles and appliances in which the motor drives a propeller for transmitting thrust to the vehicle or appliance.

Figure 1A:
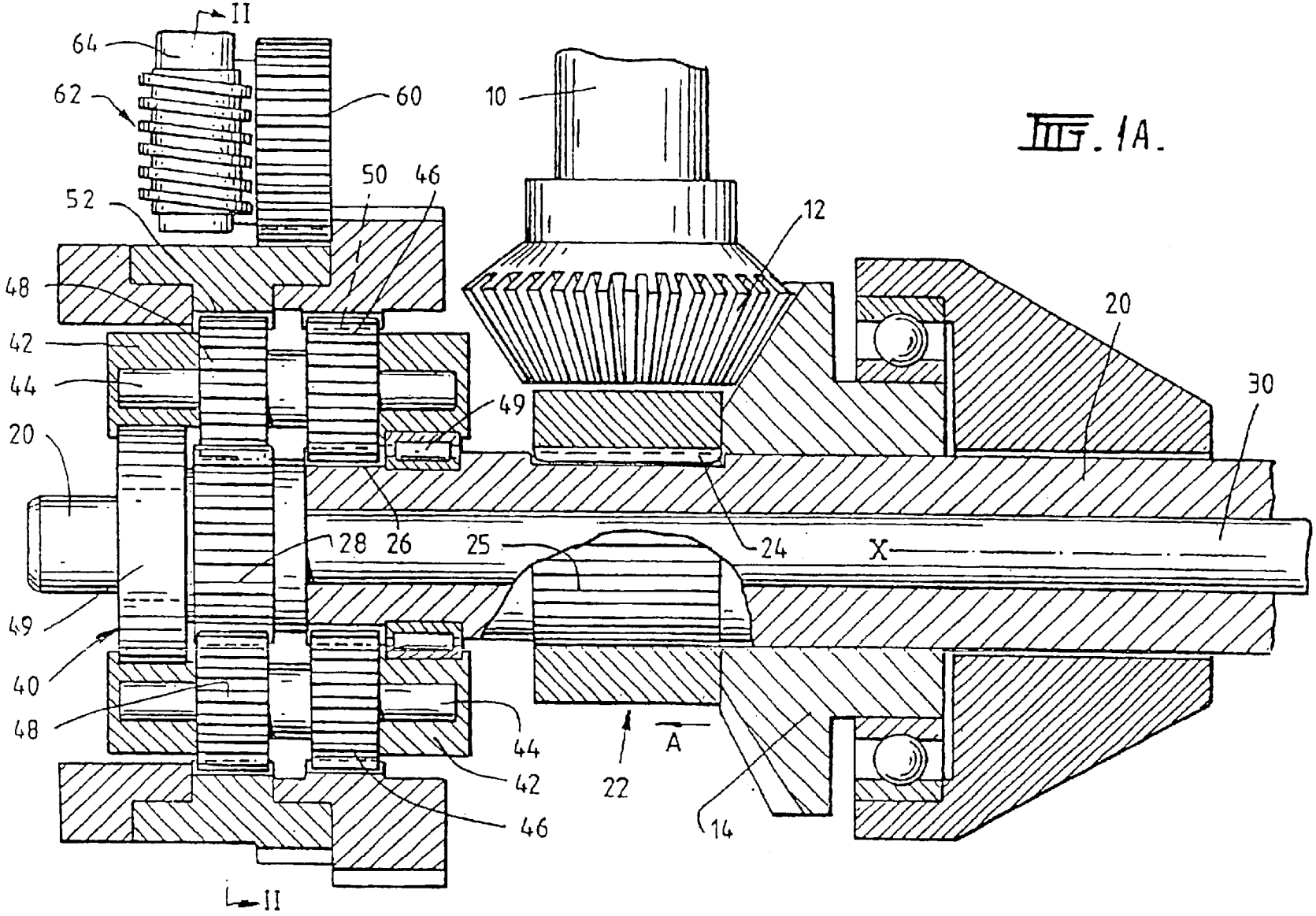
FIG. 1A is a cross-sectional view of a part of the preferred embodiment of the invention.
Figure 1B:
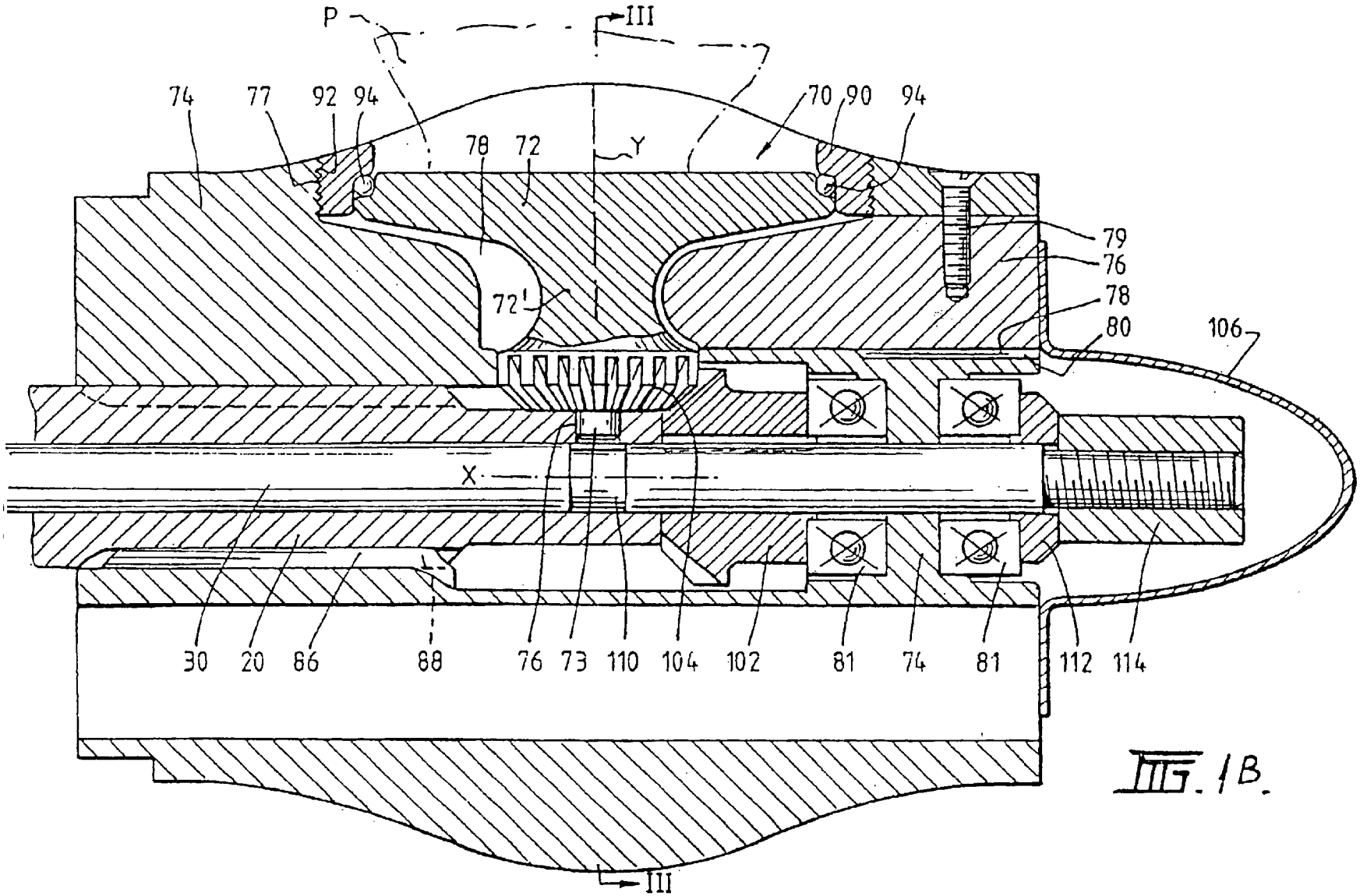
FIG. 1B is a cross-sectional view which joins with the view of FIG. 1A to show the remainder of the preferred embodiment of the invention.

With reference to FIG. 1A and FIG. 1B, a lower portion of an outboard motor is shown which includes an input drive shaft10 for supplying input rotary power from an internal combustion engine (not shown) in a conventional way. The shaft 10 carries a bevel gear 12 at its lowermost end. The bevel gear 12 meshes with a bevel gear 14 which is provided on a first output shaft 20. A dog 22 has splines 24 which mesh with splines on the first output shaft 20 and engages the bevel gear 14 to couple the bevel gear 14 to the first output shaft 20 so that when the input shaft 10 is rotated, drive is transmitted from the bevel gear 12 to the bevel gear 14 on the first output shaft 20 to rotate the first output shaft 20 about a drive axis X. The dog 22 can be slid in the direction of arrow A in FIG. 1B to disengage from the bevel gear 14 to unlock the bevel gear 14 from the output shaft 20 to disconnect supply of rotary power to the first output shaft 20 as is known so that if it is desired to completely stop rotation of the propeller blades, the dog 22 is moved to disengage from the shaft 14 so that output rotary power is not supplied to the first output shaft 20 so the propeller blades do not rotate. This is a desired safety factor for outboard motors in the event that it is required to stop rotation of the propeller blades for safety reasons. The mechanism for sliding the dog 22 in the direction of arrow A and back into engagement with the bevel gear 14 to lock the bevel gear 14 to the first output shaft 20 is not shown because such mechanisms are known and do not form part of the present invention.

Figure 2:
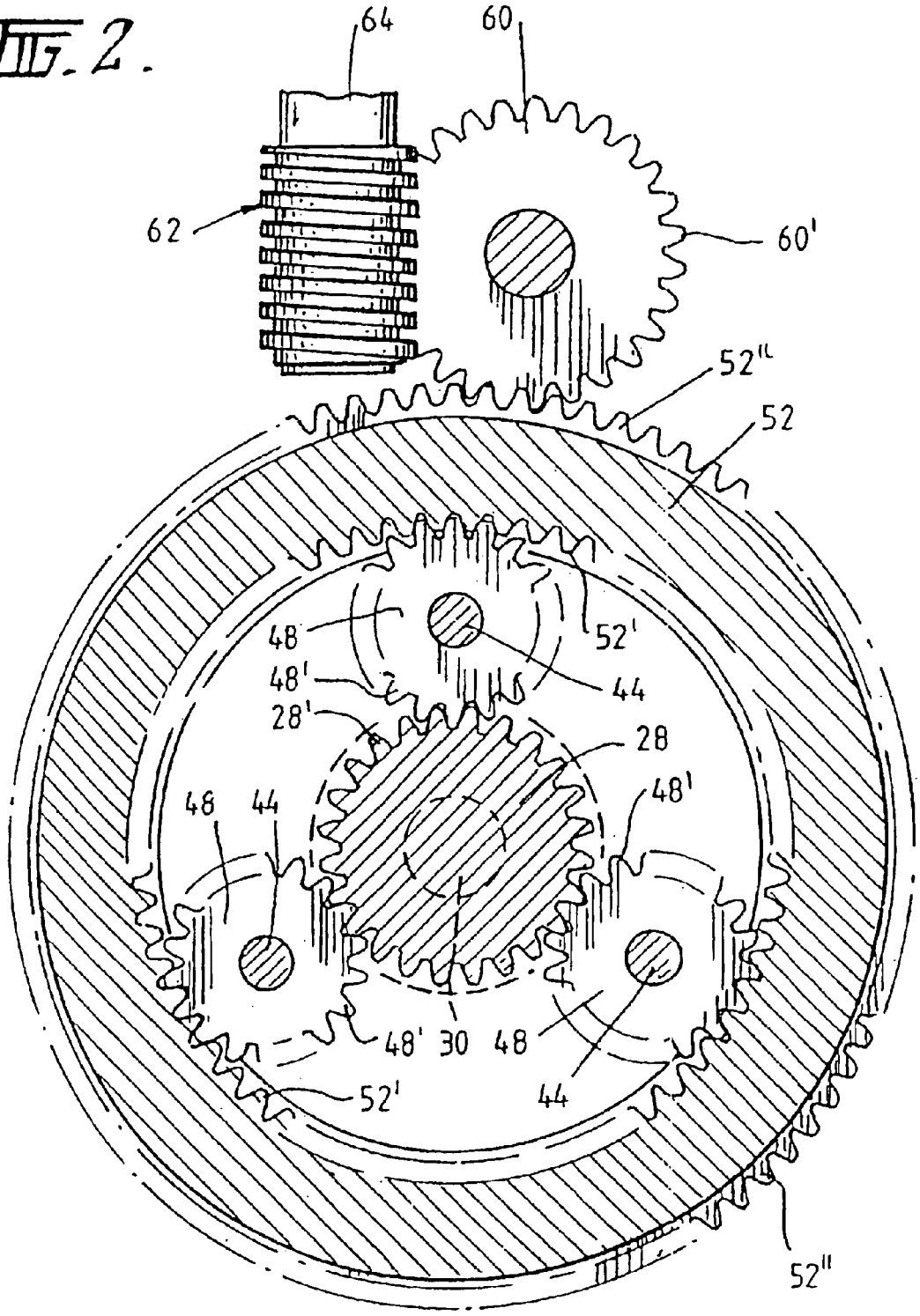
FIG. 2 is a cross-sectional view along the line II—II of FIG. 1A.

A second output shaft 30 is arranged coaxially within the first output shaft 20. The first output shaft 20 has a first gear 26 and the second output shaft 30 carries a second gear 28. A planet cage 40 is mounted on the first output shaft 20 and second output shaft 30 and generally comprises cage elements 42 which carry a plurality of planet shafts 44 (three in the preferred embodiment). A plurality of first planet gears 46 (three in the preferred embodiment as is shown in FIG. 2) are arranged on the planet shafts 44 and mesh with the first gear 26 on the first output shaft 20. A second plurality of planet gears 48 are also provided on the planet shafts 44 and mesh with the second gear 28 on the second output shaft 30.

The cage elements 42 are supported for rotation relative to the shafts 20 and 30 by bearings 49. A fixed orbit gear 50 is provided about the cage 40 and meshes with the planet gears 46. A movable orbit gear 52 is also provided about the cage 40 and meshes with the planet gears 48.

As is best seen in FIG. 2, the orbit gear 52 has internal teeth 52' which mesh with teeth 48' on the planet gears 48. The teeth 48' of the planet gears 28 mesh with teeth 28' of the second gear 28 provided on the second output shaft 30.

The arrangement of the fixed orbit gear 50 and the planet gears 46 is generally the same as shown in FIG. 2 as should be apparent from inspection of FIG. 1A. However, the movable orbit gear 52 has external teeth 52" on its outer circumference which engage with an actuating gear 60 via teeth 60' on the actuating gear. The actuating gear 60 is driven about its central axis by a worm drive mechanism 62 which includes an input shaft 64 which is driven by a servo-motor (not shown) or the like under suitable control such as microprocessor or computer control to turn the worm drive 62 to rotate the gear 60. Rotation of the gear 60 will transmit drive to the orbit gear 52 to rotate the orbit gear 52 as will be described in more detail hereinafter.

When input rotary power is supplied to the input shaft 10, rotary power is transmitted to the first drive shaft 20 via the bevel gears 12 and 14 as previously described. This causes the shaft 20 to rotate about the drive axis x which drags the planet cage 40 about the axis X in view of engagement between the planet gears 46 and the gear 26 on the first output shaft 20. Movement of the planet cage 40 causes the planet gears 48 to transmit drive to the second output shaft 30 via the engagement between the planet gears 48 and the second gear 28 on the output shaft 30 so that the first output shaft 20 and second output shaft 30 are rotated at the same speed and therefor in phase with respect to one another.

Figure 3:
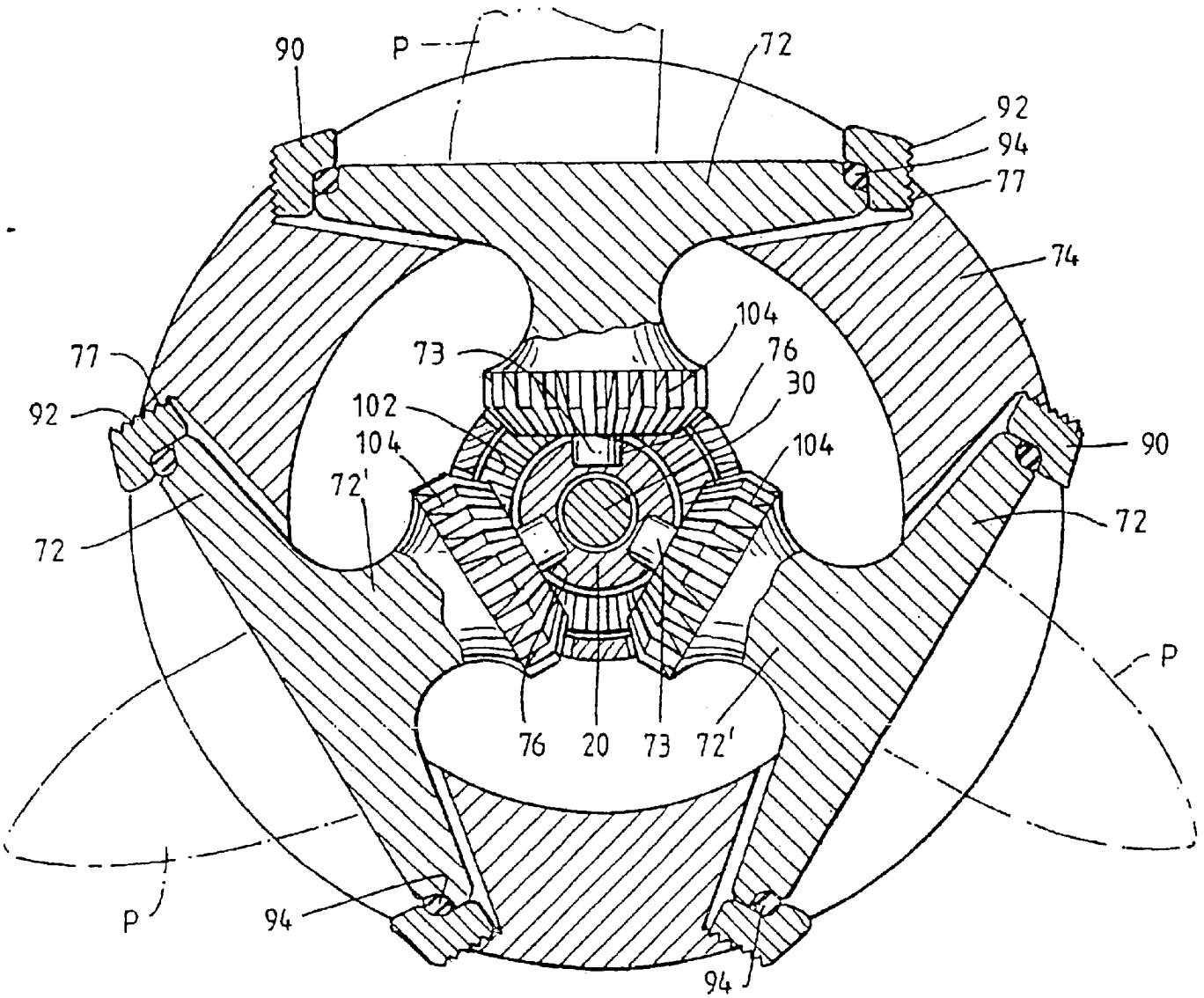
FIG. 3 is view along the line III—III of FIG. 1B.

As is shown in FIG. 1B which forms a continuation of FIG. 1A, rotation of the output shaft 20 and the output shaft 30 will rotate a propeller 70 which has a plurality of propeller blades P (only one shown in FIG. 1B and shown in dotted lines in FIG. 1B). Rotation of the propeller 70 about the drive axis X at the shafts 20 and 30 provides propulsion to propel a boat through the water in the known way. With reference to FIG. 1B, the propeller 70 includes a plurality of mountings 72 (three in the preferred embodiment as is evident from FIG. 3) which are arranged within casing or hub 74. Each mounting 72 includes a radially inwardly arranged stem 73 which locates in a hole 76 in the first output shaft 20 so as to mount the mounting 72 for rotation about radial axis Y shown in FIG. 1B. The casing 74 includes an opening 78 for receiving the mounting 72, a screw thread 79 is arranged on the casing 74 and, as shown in FIG. 1B, the casing 74 can be bolted to rear casing section 76 by a bolt or screw 79. The rear casing 76 is provided with a spline 78 which engages with a spline 80 on the end portion 74' of the casing 74 and the casing 74 at the end portion 74 is mounted on the second input shaft 30 by bearings 80 so that relative rotation can take place between the second input shaft 30 and the propeller 70. The casing 74 is also connected to the first input shaft 20 via splines 86 on the casing 74 and splines 88 on the first input shaft 20 so that when the first input shaft 20 rotates about the drive axis, the propeller 70 is rotated about the drive axis X to provide propulsion to the boat to which the outboard motor is connected.

As is clearly shown in FIG. 1B, the mounting 72 is arranged within the opening 78 with the stem 73 being received in the hole 76*a* in the first output shaft 20. A cap 90 having a screw thread 92 is screw threaded with the screw thread 92 and a seal 94 is provided between the mounting 72 and the cap 90 so that the mounting 72 is securely retained within the opening 78 by the cap 90 with the stem 73 held in the hole 76*a* in the output shaft 20.

The second output shaft 30 carries a bevel gear 102 and the lower portion 72' of the mounting 72 carries a bevel gear 104 which meshes with the bevel gear 102 fixed on the second output shaft 30. The rear of the output shafts 20 and 30 may be sealed by an end cover 106 which is fixed to the casing portion 76.

When the output shaft 30 and output shaft 20 rotate in phase with respect to one another (and therefore at the same speed) the bevel gear 102 rotates with the bevel gear 104 without transmitting any drive to the bevel gear 104. However, if the phase relationship between the shafts 20 and 30 is changed so that the shafts 20 and 30 no longer rotate at the same speed, the bevel gear 102 transmits drive to the bevel gear 104 to rotate the mounting 72 about the radial axis Y to change the pitch of the propeller blades P relative to the radial axis Y so the pitch of the propeller blades P can be set at the most efficient position depending on the condition of the motor or drive conditions of the boat to which the motor is connected.

In order to change the phase relationship between the shafts 20 and 30, the servo motor (not shown) drives the shaft 64 to cause the worm drive 62 to rotate gear 60. Rotation of the gear 60 rotates the movable orbit gear 52 to cause the planet gears 48 to advance or regress relative to the planet gears 46 so that the phase relationship or speed of the output shafts 20 and 30 changes to drive the bevel gear 104 via the bevel gear 102 to change the pitch of the propeller P as previously described. Thus, the pitch of the propeller P can be adjusted to an optimum position depending on the environment and conditions of use of the outboard motor.

FIGS. 4A, 4B, 5, and 6 show a second embodiment of the invention in which like reference numerals indicate like parts to those previously described. In this embodiment, the phase adjuster mechanism 40 is generally identical to that previously described as is the dog 22 (except the dog 22 is shown in more detail) for engaging and disengaging the gear 14 with the drive shaft 20. In this embodiment, instead of providing a worm drive mechanism for transmitting drive to the gear 60, a drive shaft 61 is provided with a bevel gear 60' which engages a bevel gear 60" mounted onto the gear 60. Thus, rotation of the shaft 61 will cause the gears 60' and 60" to rotate the gear 60 to in turn operate the phase adjuster 40 in exactly the same manner as previously described. Thus, the phase adjuster 40 will not be described in any further detail with reference to FIGS. 4A, 4B, 5, and 6.

The difference between this embodiment of the invention and that previously described largely resides in the fact that this embodiment includes a backlash preventing mechanism 250 with the coupling between the second output shaft 30 and the propeller blades P which prevents oscillating of the propeller blades which may otherwise impair the operation of the motor. Since the phase adjuster mechanism 40 includes gear trains which have involute or convolute surfaces a certain degree of backlash is inherent in the gear train. If the propeller blade is coupled to the shaft 30 by a gear such as the bevel gear as previously described backlash will also be possible in that bevel gear. If the propeller blades P stop at a particular position whereby the centre of gravity of the propeller blade can cause the propeller blade to move slightly in view of the backlash in the gear train, the propeller blade can oscillate about a central mean position to which its pitch has been adjusted which will impair efficiency and possibly completely prevent drive from being transmitted from the motor.

Figure 5:
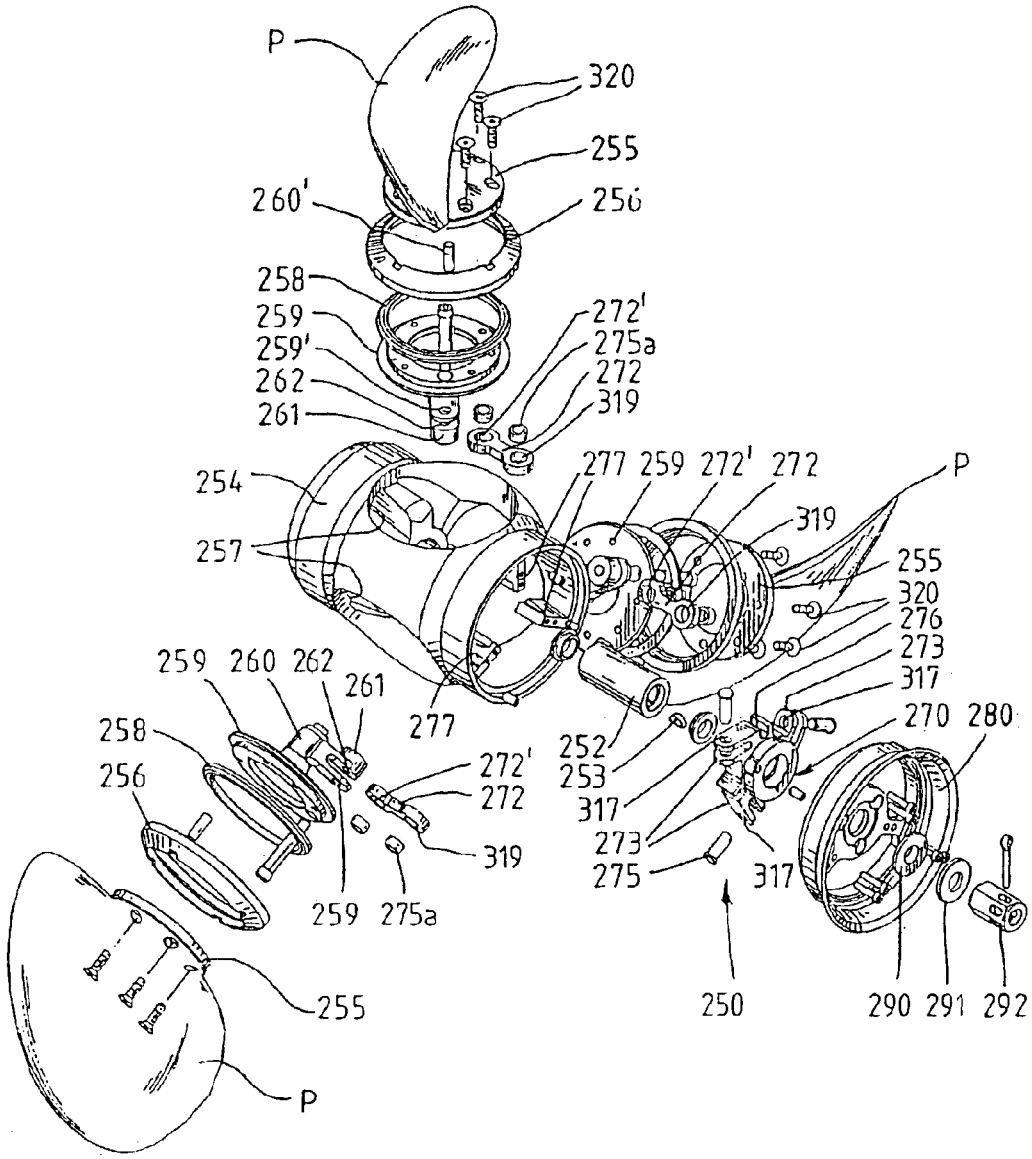
FIG. 5 is an exploded perspective view of the part shown in FIG. 4B.

The device 250 comprises a screw-threaded section 252 coupled to or formed on the output shaft 30. In the preferred embodiment, the screw-threaded section 252 is formed separate from the shaft 30 and is coupled to the shaft 30 by a key 253 which locates within a groove or recess on the interior surface of the section 252 and also engages in a slot or groove (not shown) in the shaft 30 to thereby couple the section 252 onto the shaft 30. A yoke 270 having an internal screw-thread is screw-threaded onto the section 252. The yoke 270 has three tangentially extending arms 273 which are bifurcated as best shown in FIG. 5. At one end of the arms 273, guide grooves 276 are provided. When assembled, the guide grooves 276 receive flanges 277 within casing or hub 254 so that the yoke 270 cannot rotate about the axis X of the shafts 20 and 30 and is therefore restrained for longitudinal movement on the screw-threaded section 252 in the direction of the axis of the shafts 20 and 30.

A link 272 is received by each of the bifurcated arms 273 and is coupled to the arms 273 by a pin 275 which passes through a hole 317 in the bifurcated arms 273 and a hole 319 in the link 272. A bush 275*a* may be provided between the pin and the hole 317 in the link 272. The link 272 has a second hole 272' at its other end for coupling to the propeller P as will be described in more detail below.

The propeller P has a mounting plate 254 which bolts to a base plate 259 by bolts or screw 320. The base plate 259 is retained within the hub 254 by a retaining ring 256 which locates in a respective opening 257 in the hub 254. The ring 256 may be coupled in the opening 257 by grub screws (not shown) which extend longitudinally in the hub and engage peripheral portions of the ring 256 to lock the ring 256 to the hub 254. A bearing ring 258 may be imposed between the ring 256 and the base plate 259. The base plate 259 has a hole 259' for receiving a pin 260' and the pin 260' is received by hole 262 provided in a bifurcated portion of the end of a link 261. The link 261 extends radially outwardly from a central axle 260 coupled to the plate 259.

The link 272 is coupled to the link 261 by the link 272 being inserted into the bifurcated portion of the link 261 and the pin 260' passing through the opening 272' as well as the openings 262 in the link 261.

The hub 254 may be closed by an end plate 280 which receives a thrust washer 292 which, in turn, receives a reverse thrust bearing 290, a thrust washer 291 and a locking nut 292.

Figure 4A:
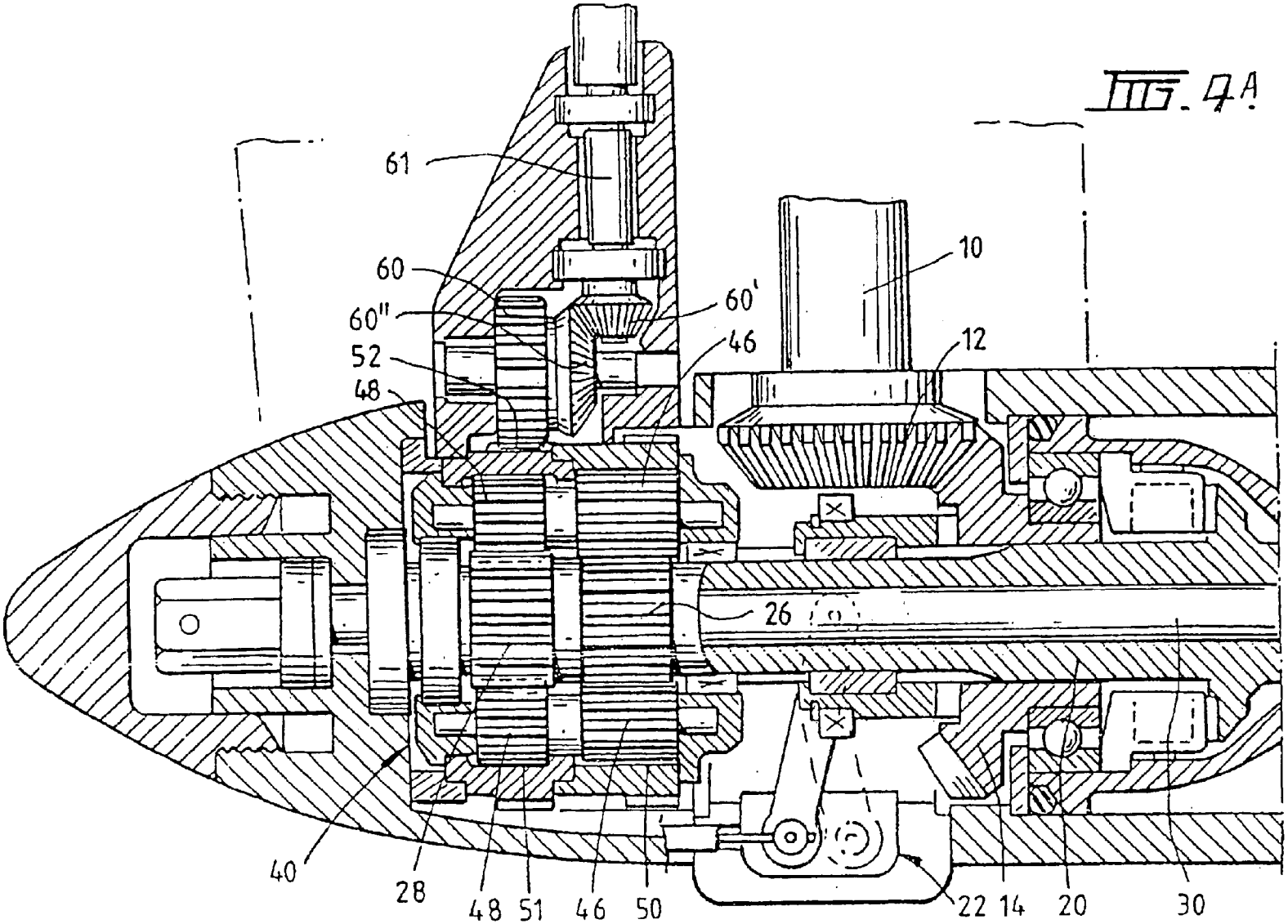
FIGS. 4A and 4B are a cross-sectional view of a second embodiment of the invention.
Figure 4B:
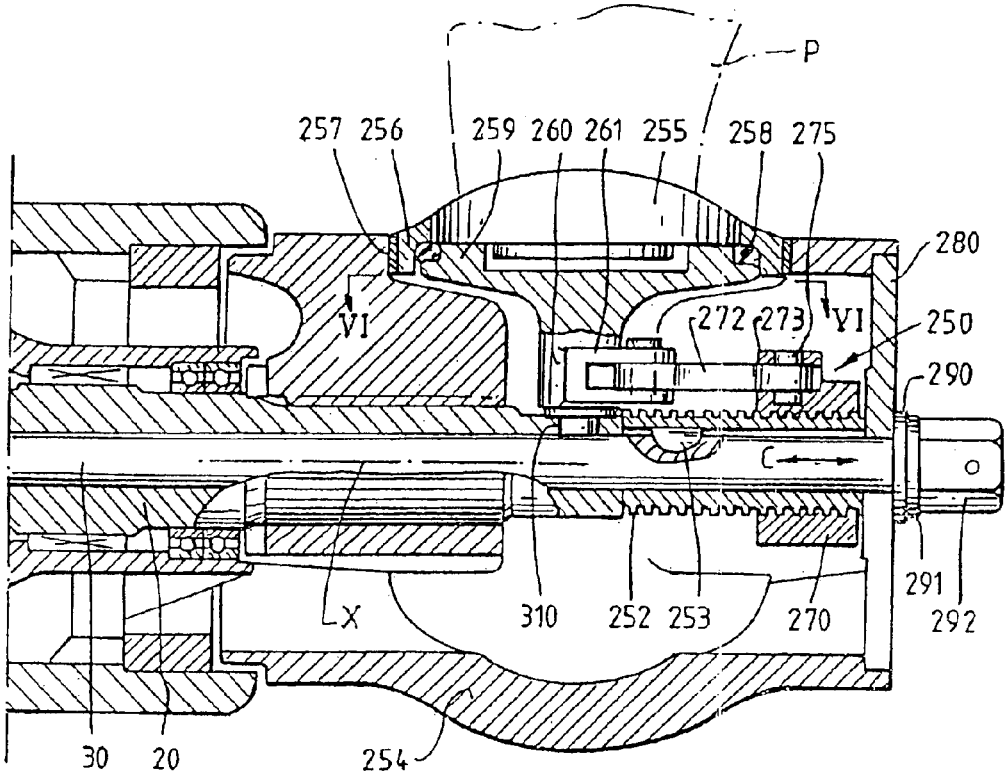
Figure 6:
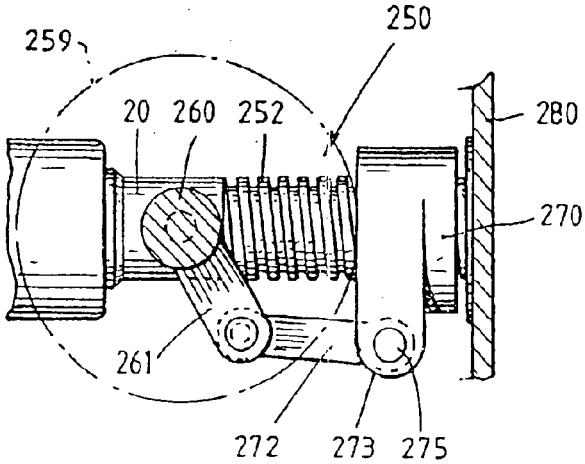
FIG. 6 is a cross-sectional view generally along the line VII—VII of FIG. 4B.

As best shown in FIGS. 4B and 6 when the phase adjuster mechanism 40 is operated to cause the shaft 30 to rotate relative to the shaft 20 so as to adjust the position of the propeller blades P, the relative rotation between the shafts 20 and 30, and therefore between the hub 254 and the shaft 30, causes the yoke 270 to be driven along the screw-threaded section 252 in the direction of double headed arrow C, depending on the direction of rotation of the shaft 30. Movement of the yoke 270 will cause the link 272 to also move to push or pull the link 261 in view of the coupling of the link 272 to the link 261. This will therefore cause the plate 259 to rotate about the radial axis of the propeller P to adjust the pitch of the propeller P relative to the radial axis.

The propeller P is mounted for rotation in the openings 257 by the axle 260 locating within an opening 310 (see FIG. 4B) on the drive shaft 20 and this, together with the rings 256 and 258, facilitate rotation of the base plate 259 and therefore the mounting plate 254 and propeller blades P about the radial axis within the hub 254 to change the pitch of the propeller blades P.

Thus, as in the previous embodiment, when the drive shaft 20 is driven by the input power supply, rotation is transmitted to the hub so that the hub 254 is rotated about the axis of the drive shaft 20 so the propellers can create drive. When it is necessary to adjust the pitch of the propellers, the phase adjuster mechanism 40 is operated so that the shaft 30 is rotated relative to the shaft 20 to in turn rotate the propeller blades P about the radial axis via movement of the yoke 270 on the screw-threaded section 252 which is transmitted via the links 272 and 261 to rotate the base plate 259 and therefore the propeller blade P about the radial axis.

In this embodiment, because the shaft 30 is coupled to the propeller blades P by the screw-threaded section 252 and the yoke 270 rather than a complete gear train as in the previous embodiment, any backlash in the gear train is not transmitted beyond the screw-threaded section 252 and yoke 270 to the propeller blade P. Thus, any backlash in the phase adjuster 40 will not result in any oscillating movement of the propeller blades. P after adjustment to a particular position. Thus, adjustment of the pitch angle of the propeller blades P is precise and because of the engagement of the screw-threads on the yoke 270 and the screw-threads on the section 252 no free play is allowed and the coupling is effectively a rigid coupling. Thus, regardless of where the centre of gravity of the propeller blade P may lie, there is no backlash in the system which can be transmitted to the propeller blade P which will enable the propeller blade P to oscillate after adjustment to a particular position.

The phase adjuster referred to above and shown in FIG. 1A is disclosed in our co-pending international application PCT/AU96/00763. The contents of that international application are incorporated into this specification by this reference.

Since modifications within the spirit and scope of the invention may readily be effected by persons skilled within the art, it is to be understood that this invention is not limited to the particular embodiment described by way of example hereinabove.

What is claimed is:

1. A motor for driving a propeller having a plurality of propeller blades, including:

a first output shaft having a drive axis for driving the propeller around the drive axis;

a second output shaft having a drive axis common with the drive axis of the first output shaft;

a coupling device for coupling the second output shaft to each propeller blade of the propeller for rotating the propeller blades about respective radial axes transverse to the drive axes of the first and second output shafts to change the pitch of the propeller blades relative to the radial axes;

an input for supplying input rotary power to the first and second output shafts for driving the first and second output shafts about the drive axes to transmit rotary power to the propeller;

a phase adjuster for adjusting the phase relationship between the first and second output shafts so that one of the output shafts rotates relative to the other of the output shafts with the relative rotation causing the coupling device to rotate the propeller blades about the respective radial axes to change the pitch of the blades relative to the radial axes;

a backlash preventing device for preventing oscillation of the propeller blade about the radial axes due to any backlash in the phase adjuster so any backlash is not transmitted to the propeller blades which may otherwise cause the propeller blades to oscillate; and wherein the phase adjuster comprises:

a cage coupled to the input via the first and second output shafts and the input for input of rotary power;

a first gear on the first output shaft;

a second gear on the second output shaft;

a first planet gear in meshing engagement with the first gear on the first output shaft;

a second planet gear in meshing engagement with the second gear on the second output shaft;

a first orbit gear arranged for rotation relative to the first and second output shafts and meshing with the first planet gear and a second orbit gear arranged for rotation relative to the output shafts and engaging the second planet gear, one of the first or second orbit gears being fixed and the other of the first and second orbit gears being movable relative to the said one of the orbit gears; and an adjusting element for moving the movable orbit gear to cause the planet gear associated with that orbit gear to advance or regress relative to the other planet gear to thereby change the phase relationship between the first and second output shafts and to alter the pitch of the propeller blades via the coupling device which couples the second output shaft to each propeller blade.

2. A motor for driving a propeller having a plurality of propeller blades, including:

a first output shaft having a drive axis for driving the propeller around the drive axis;

a second output shaft having a drive axis common with the drive axis of the first output shaft;

a coupling device for coupling the second output shaft to each propeller blade of the propeller for rotating the propeller blades about respective radial axes transverse to the drive axes of the first and second output shafts to change the pitch of the propeller blades relative to the radial axes;

an input for supplying input rotary power to the first and second output shafts for driving the first and second output shafts about the drive axes to transmit rotary power to the propeller;

a phase adjuster for adjusting the phase relationship between the first and second output shafts so that one of the output shafts rotates relative to the other of the output shafts with the relative rotation causing the coupling device to rotate the propeller blades about the respective radial axes to change the pitch of the blades relative to the radial axes; and a backlash preventing device for preventing oscillation of the propeller blade about the radial axes due to any backlash in the phase adjuster so any backlash is not transmitted to the propeller blades which may otherwise cause the propeller blades to oscillate; and wherein the backlash preventing device is provided in the coupling device for coupling each propeller blade to the second output shaft and includes:

a screw-threaded section coupled to or provided on the second output shaft;

a yoke provided on the screw-threaded section for movement on the screw-threaded section in the longitudinal direction of the second output shaft, the yoke having a screw thread which directly engages the screw-threaded section; and the engagement between the screw-threaded section and the yoke forms a substantially rigid coupling of the second output shaft to the propeller blades so that any backlash in the phase adjuster is not transmitted through the coupling device to the propeller blades.

3. A motor according to claim 2, wherein the phase adjuster comprises:

a cage coupled to the input via the first and second output shafts and the input for input of rotary power;

a first gear on the first output shaft;

a second gear on the second output shaft;

a first planet gear in meshing engagement with the first gear on the first output shaft;

a second planet gear in meshing engagement with the second gear on the second output shaft;

a first orbit gear arranged for rotation relative to the first and second output shafts and meshing with the first planet gear and a second orbit gear arranged for rotation relative to the output shafts and engaging the second planet gear, one of the first or second orbit gears being fixed and the other of the first and second orbit gears being movable relative to the said one of the orbit gears; and an adjusting element for moving the movable orbit gear to cause the planet gear associated with that orbit gear to advance or regress relative to the other planet gear to thereby change the phase relationship between the first and second output shafts and to alter the pitch of the propeller blades via the coupling device which couples the second output shaft to each propeller blade.

4. A motor according to claim 2, wherein the coupling device further includes a device for preventing rotation of the yoke on the screw-threaded section so that when the second output shaft is rotated relative to the first output shaft, the yoke is caused to move longitudinally on the screw-threaded section, the coupling device further having a link coupled between the yoke and the propeller blade so that when the yoke moves on the screw-threaded section, the link is moved to in turn cause the propeller blade to rotate about the respective radial axes to adjust the pitch of the blades relative to the radial axes.

5. A motor for driving a propeller having a plurality of propeller blades, including:

a first output shaft having a drive axis for driving the propeller around the drive axis;

a second output shaft having a drive axis common with the drive axis of the first output shaft;

coupling device for coupling the second output shaft to each propeller blade of the propeller for rotating the propeller blades about respective radial axes transverse to the drive axes of the first and second output shafts to change the pitch of the propeller blades relative to the radial axes;

an input for supplying input rotary power to the first and second output shafts for driving the first and second output shafts about the drive axes to transmit rotary power to the propeller;

a phase adjuster for adjusting the phase relationship between the first and second output shafts so that one of the output shafts rotates relative to the other of the output shafts with the relative rotation causing the coupling device to rotate the propeller blades about the respective radial axes to change the pitch of the blades relative to the radial axes; and a backlash preventing device for preventing oscillation of the propeller blade about the radial axes due to any backlash in the phase adjuster so any backlash is not transmitted to the propeller blades which may otherwise cause the propeller blades to oscillate;

wherein the backlash preventing device is provided in the coupling device for coupling each propeller blade to the second output shaft and includes:

a screw-threaded section coupled to or provided on the second output shaft;

a yoke provided on the screw-threaded section for movement on the screw-threaded section in the longitudinal direction of the second output shaft, the yoke having a screw thread which directly engages the screw-threaded section; and the engagement between the screw-threaded section and the yoke forms a substantially rigid coupling of the second output shaft to the propeller blades so that any backlash in the phase adjuster is not transmitted through the coupling device to the propeller blades; and wherein the coupling device further includes means for preventing rotation of the yoke on the screw-threaded section so that when the second output shaft is rotated relative to the first output shaft, the yoke is caused to move longitudinally on the screw-threaded section, the coupling device further having a link coupled between the yoke and the propeller blade so that when the yoke moves on the screw-threaded section, the link is moved to in turn cause the propeller blade to rotate about the respective radial axes to adjust the pitch of the blades relative to the radial axes.

* * * * *